US006297718B1

(12) United States Patent
Scholz et al.

(10) Patent No.: US 6,297,718 B1
(45) Date of Patent: Oct. 2, 2001

(54) ELECTROMAGNETIC SWITCHING DEVICE WITH A MULTIPART HOUSING

(75) Inventors: Rudolf Scholz, St. Augustin; Volker Lang, Bonn; Stefan Joergens, Troisdorf; Ralf Thar, Köln, all of (DE)

(73) Assignee: Moeller GmbH, Bonn (DE)

( * ) Notice: Subject to any disclaimer, the term of this patent is extended or adjusted under 35 U.S.C. 154(b) by 0 days.

(21) Appl. No.: 09/424,472

(22) PCT Filed: Mar. 24, 1999

(86) PCT No.: PCT/EP99/02011

§ 371 Date: Nov. 23, 1999

§ 102(e) Date: Nov. 23, 1999

(87) PCT Pub. No.: WO99/50873

PCT Pub. Date: Oct. 7, 1999

(30) Foreign Application Priority Data

Mar. 31, 1998 (DE) ..... 198 14 400

(51) Int. Cl.[7] ..... H01H 9/02
(52) U.S. Cl. ..... 335/202; 335/132
(58) Field of Search ..... 335/132, 202; 200/295–307

(56) References Cited

U.S. PATENT DOCUMENTS

| | | | | |
|---|---|---|---|---|
| 3,382,469 | * | 5/1968 | Conner | 335/132 |
| 3,518,391 | * | 6/1970 | Hipple | 200/5 R |
| 4,100,517 | * | 7/1978 | Rodolfl | 335/132 |
| 4,595,812 | * | 6/1986 | Tamaru et al. | 200/307 |
| 4,691,978 | * | 9/1987 | Lemmer | 439/620 |
| 4,713,498 | * | 12/1987 | Lugwig et al. | 200/5 R |
| 5,483,213 | * | 1/1996 | Mueller et al. | 335/132 |
| 5,559,678 | * | 9/1996 | Fukuda et al. | 361/818 |
| 5,687,063 | * | 11/1997 | Chabert | 361/726 |
| 5,747,734 | * | 5/1998 | Kozlowski et al. | 174/50 |

* cited by examiner

*Primary Examiner*—Lincoln Donovan
(74) *Attorney, Agent, or Firm*—Kenyon & Kenyon

(57) ABSTRACT

An electromagnetic switching device with a multipart housing. The magnet core of the switching device, including the coil, is accommodated in one of the housing parts. Identical connecting modules are provided for each outer terminal of the device. These connecting modules can be slipped on on the top side of the housing part in which the magnet core is accommodated, in the area of the four corners of said housing part. A blank module is configured externally in the same way and can be slipped on on the corner of the housing part which is not occupied by a connecting module.

13 Claims, 4 Drawing Sheets

ELECTROMAGNETIC SWITCHING DEVICE WITH A MULTIPART HOUSING

FIELD OF THE INVENTION

The present invention relates to an electromagnetic switching device having a multipart housing, in which the coil enclosing the magnet core is mounted in one of the housing parts.

RELATED TECHNOLOGY

Electromagnetic switching devices having multipart housings with a magnet core and bobbin, armature, movable contacts and stationary contacts require coil terminals, i.e. terminals for the control voltage of the device these being outer terminals connecting the device to the equipment installed at the locale. Normally, the coil terminals of the bobbin are permanently attached to the bobbin and therefore are accessible by a particular the device, i.e., these coil terminals can be mounted at different locations on a device for different devices or devices of different sizes. For a switching device according to German Patent No. 43 22 648 C1, two specially designed slots are assigned on the device housing to each of the two winding ends of a four-leg coil. The electrical connection on the four-leg coil is implemented via terminals that are shape coded to match the slots and can be inserted in these slots.

SUMMARY OF THE INVENTION

An object of the present invention is to provide an electromagnetic switching device with improved to outer terminals, in particular to make the coil terminals more universal, so that these outer terminals are available even for devices of different sizes in the same manner, thus allowing greater flexibility in that the outer terminals have the same design, yet can be mounted at different points of the electromagnetic switching device. In this manner, the electromagnetic switching device, in addition to having different sizes, can be better adapted to different on-site conditions.

The present invention provides an electromagnetic switching device having a housing part accommodating the magnet core and the coil in that identical connecting modules are provided for each outer terminal of the device and they can be mounted on the top of the housing part accommodating the magnet core in the area of the four corners of the housing part, and a blank module having the same external shape is provided and can be mounted on the corner of the housing part that is not occupied by a connecting module. According to the present invention, the outer terminals of the electromagnetic switching device are placed in connecting modules, away from the bobbin. In this case only a plug and socket connection is required via a cable between the bobbins and the connecting module. The connecting modules are all identical to one another, so that the desired number of connecting modules, normally three connecting modules, can be mounted on the housing part. Although a fourth available terminal location of the device, i.e., the housing part accommodating the magnet core, does not have to be occupied by a connecting module, for aesthetic reasons and for "closedness," a blank module is provided, which evens out the exterior shape of the connecting module and which then occupies the free spot. The blank module can also be replaced with a connecting module at a later time, for example, if another outer terminal, for example, a bus terminal, is to be implemented.

According to an examplary embodiment, of the prevent invention the connecting module or blank module according to the present invention has an generally cuboidal shape and, on its narrow lower side, a T-shaped plug-in ridge for inserting in a groove on the top of the housing part, which accommodates the magnet core and the bobbin. The connecting modules mounted on the top of the housing part in the area of the side wall extend the housing part upward and also form a guide for the additional armature housing of the electromagnetic switching device that can be mounted thereon, which is usually the armature housing that accommodates the armature.

In order to facilitate the insertion of the module in the grooves of the housing part, the T-shaped plug-in ridge ends at a distance from both vertical narrow sides of the connecting module or the blank module.

The upper narrow side of the connecting module is stepped with two shoulders and slopes outward to accommodate the terminal clamps. This makes it possible to connect a cable having a plug-in connector into the inside of the housing part, i.e., to the coil, for example, on the longer vertical side of the connecting module, formed by the stepping of the upper narrow side. This connecting side of the connecting module is designed, in principle, as a guide channel and is delimited by the side walls of the connecting module. The blank module also has a similar connecting side with a guide channel.

In order to allow the connecting module and the blank module to be installed and securely fastened in the housing part, it is proposed that the housing part accommodating the connecting module and the blank module be inserted in the wall on the top of two parallel side walls from above, and the ridges that widen the wall be installed with the grooves parallel to the side walls in which the modules can be installed. In order to facilitate the insertion of the modules, the grooves of one side wall are open at their ends facing one another for insertion of the T-shaped plug-in ridge of the modules. Thus the modules can be plugged onto the housing part and then can be made to slide outward toward the corners, and the modules installed on one side can be fastened using the armature housing, preventing them from being pulled out after the two housing parts of the device have been joined.

The arrangement according to the present invention of the connecting modules for the outer terminals of the electromagnetic device in the area of the magnet coil on the outer corners of the housing allows easy access for producing a connection at a later time, as well as multiple applications. The terminals can be manufactured so that they are easily accessible at all times even under conditions of limited space due to the fact that the connecting modules are located at the corners of the device.

BRIEF DESCRIPTION OF THE DRAWINGS

The invention is elucidated in the following based on the drawings in which drawing, and the coil with the connecting modules and a blank module.

DETAILED DESCRIPTION

Figure 1:
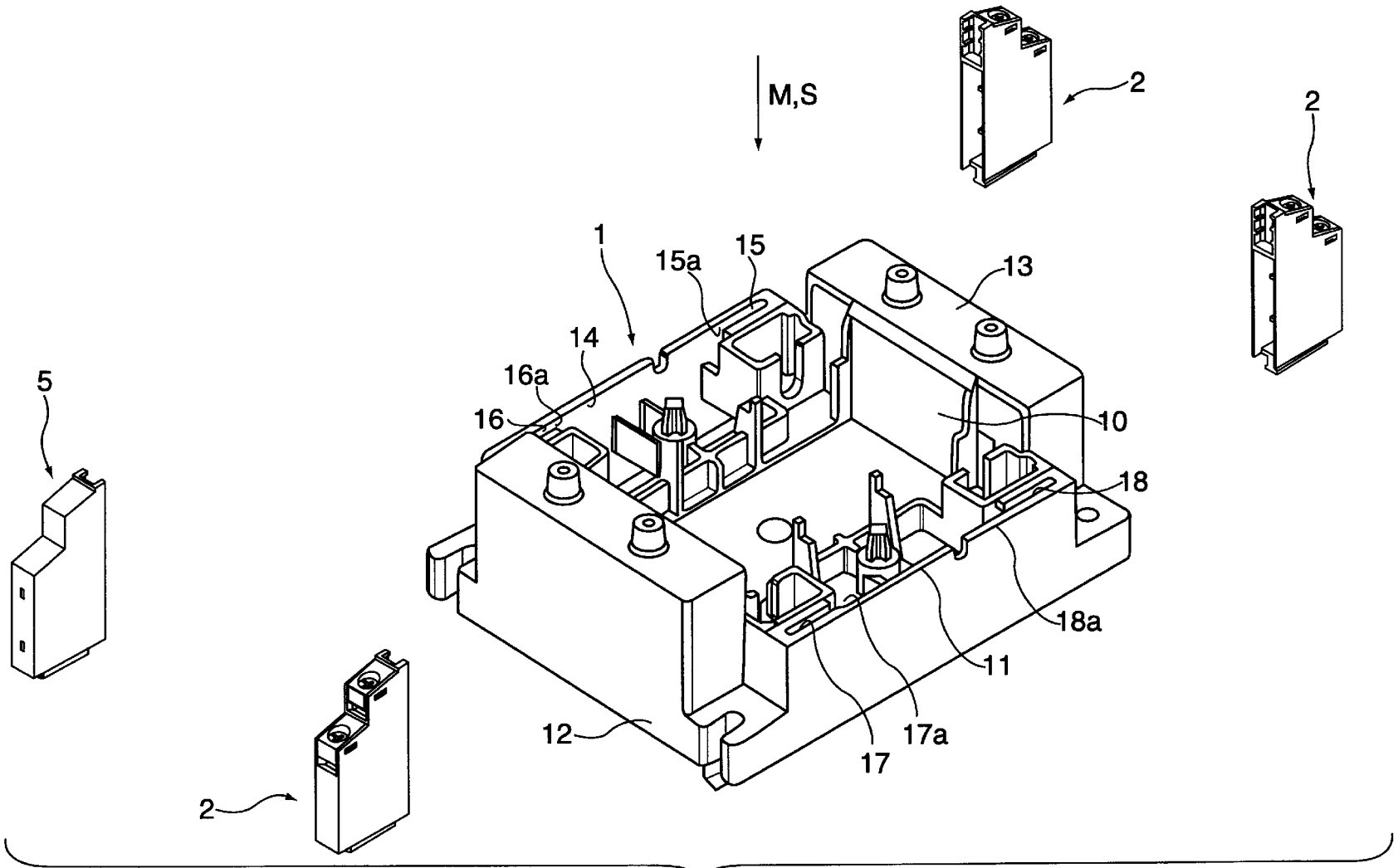
Figure 2:
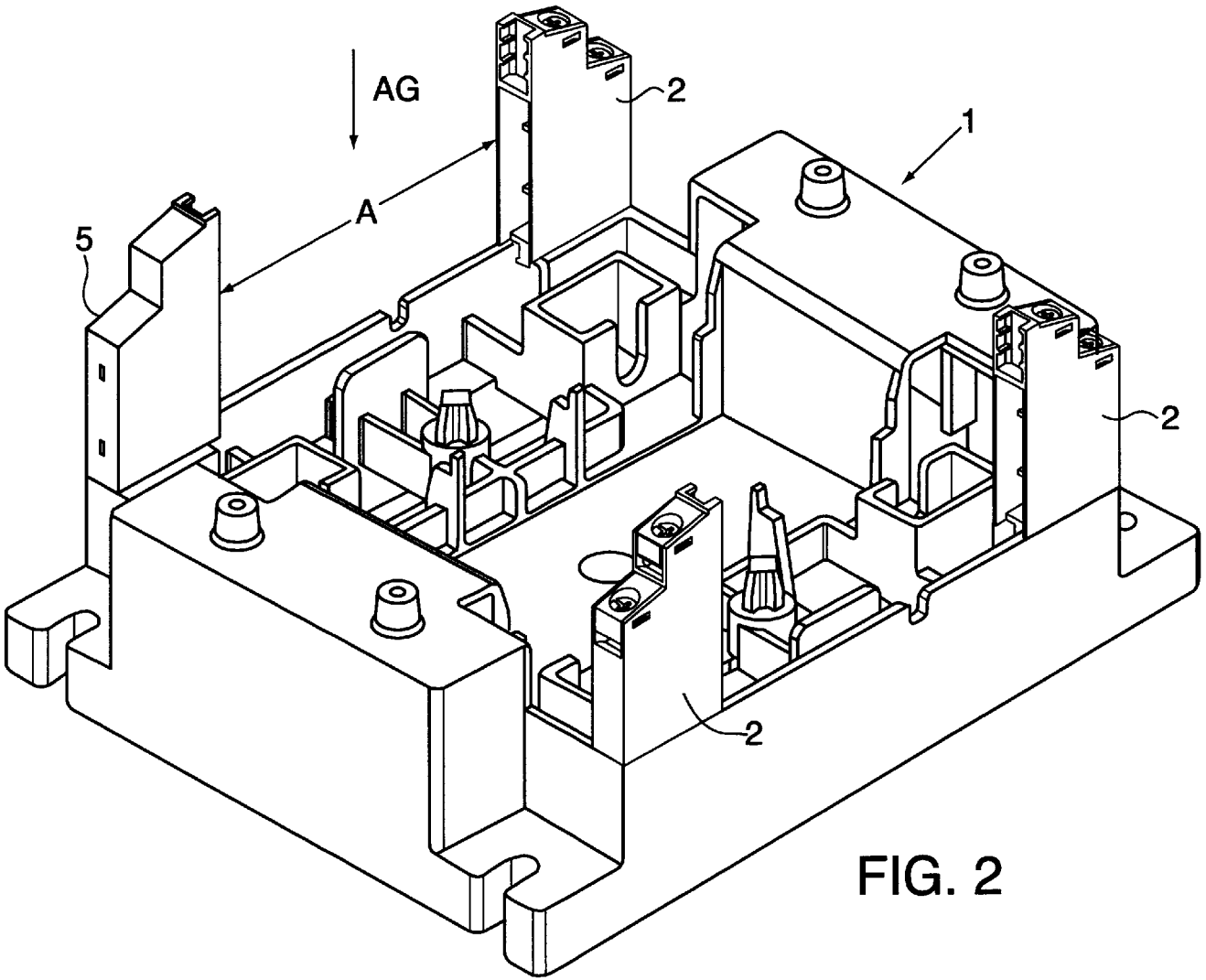
FIG. 2 shows the housing part with the connecting modules and the blank module after assembly.

Housing part 1 of an electromagnetic switching device, which accommodates magnet core M (not shown in detail)

and coil S, according to FIG. 1, forms an accommodating housing space 10, delimited by side walls 11, 12, 13, 14. Magnet core M and coil S are inserted in this space in the direction of the arrow. In order to produce the coil connections and electronic connections or a bus connection, i.e., external connections, which are produced on site during installation on the customer's devices, the electromagnetic switching device must be provided with appropriate terminals, which are produced, according to the present invention, using connecting modules 2, installed, as shown in FIG. 2, in the corner areas of parallel side walls 10, 11.

Figure 3A:
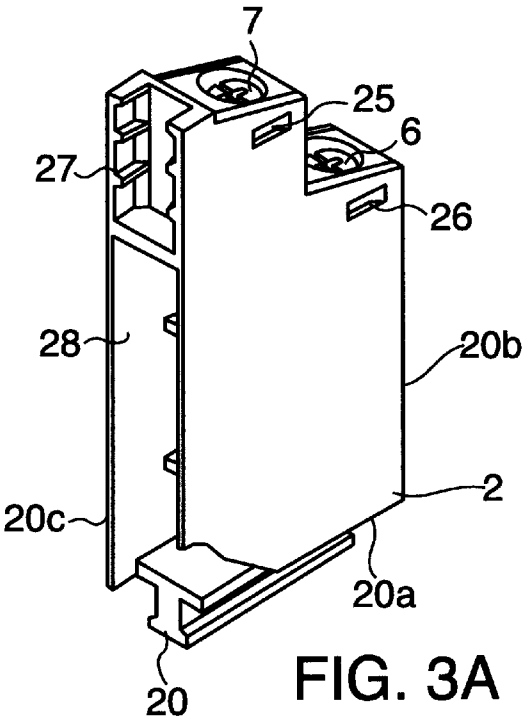
FIGS. 3*a*, 3*b* show two perspective views of the connecting module.
Figure 3B:
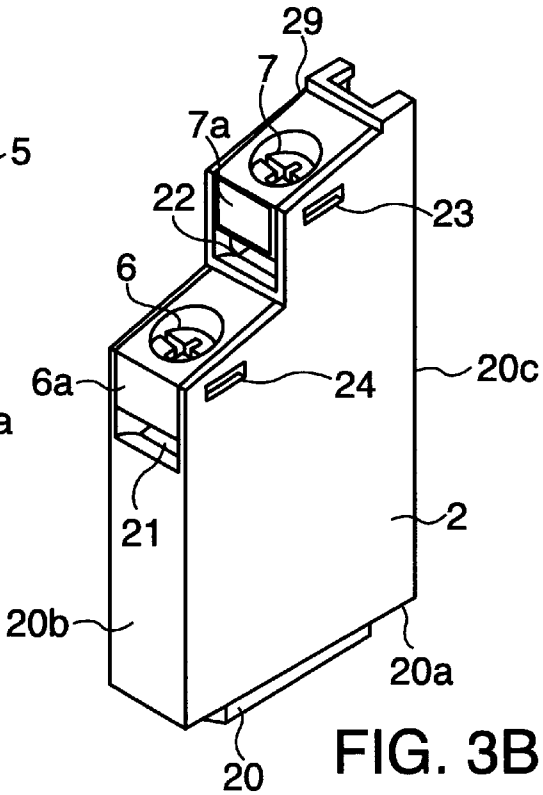
Figure 4:
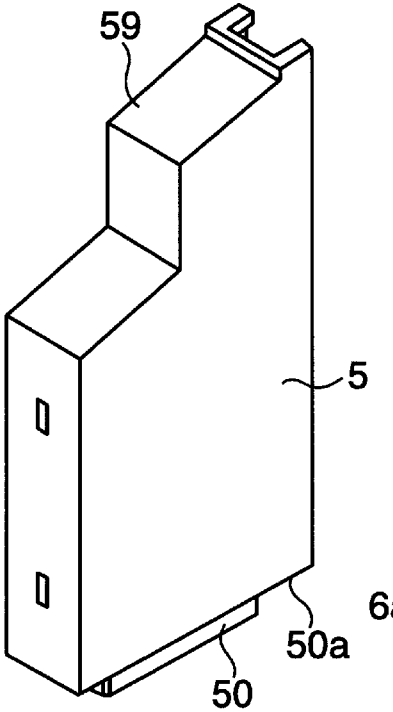
FIG. 4 shows a perspective view of the blank module.

Connecting modules 2 (FIGS. 3*a,b*) have an generally cuboidal body, which features a T-shaped plug-in ridge 20 formed on its narrow bottom side 20*a*. However, T-shaped plug in ridge 20 ends shortly before reaching the two vertical narrow sides 20*b*, 20*c* of connecting module 2, i.e., it is shorter than the length of bottom sides 20*a*. The opposite narrow top side of connecting module 2 is stepped, having two stepped shoulders 29, with connecting clamps 6 and 7 with insertion aids 6*a*, 7*a* being used between the side walls of the cuboidal connecting module 2, forming insertion slots 21, 22 for cables. Laterally, in the area of the insertion aids, slots 23, 24, 25, 26 are provided on both sides of connecting module 2 for snapping in the insertion aids. Thus the shorter vertical narrow side 20*b* of connecting module 2 forms the assembly side for the outer terminals. The longer vertical narrow side 20*c*, on the other hand, has a connecting chamber 28 for connecting into the inside of the device. A U-shaped channel, that is open outward and accommodates connecting chamber 28, is formed between the side walls of the connecting module. Cables having plug connectors can be run without difficulty in this channel to the inside of the device, i.e., in this case of the housing part, to the bobbin for the coil terminal, for example. In addition, the connecting module is provided and designed to accommodate devices, for example, filters, soft magnetic cores, or absorbers for the suppression of excessive EMC (electromagnetic compatibility) levels. Terminal area 27 is used for additional fastening via the armature housing and for additional strength while the control leads are connected.

In many electromagnetic switching devices, only three outer terminal areas are needed; therefore three corresponding connecting modules 2 (FIGS. 1 and 2) are provided. These three connecting modules 2 can be provided on three of the four corners of the housing part, assigned according to the design of the device and the customer's wishes. In order not to leave the fourth corner empty, a blank module 5 is provided according to the present invention, which has an external shape that is identical to that of connecting module 2 and is also provided with a T-shaped plug-in base 50 so that it can be mounted on its bottom 50*a*, in the same manner as connecting module 2. The top of the blank module is also stepped 29 and a U-shaped guide channel is also formed on its longer vertical narrow side.

Figure 5:
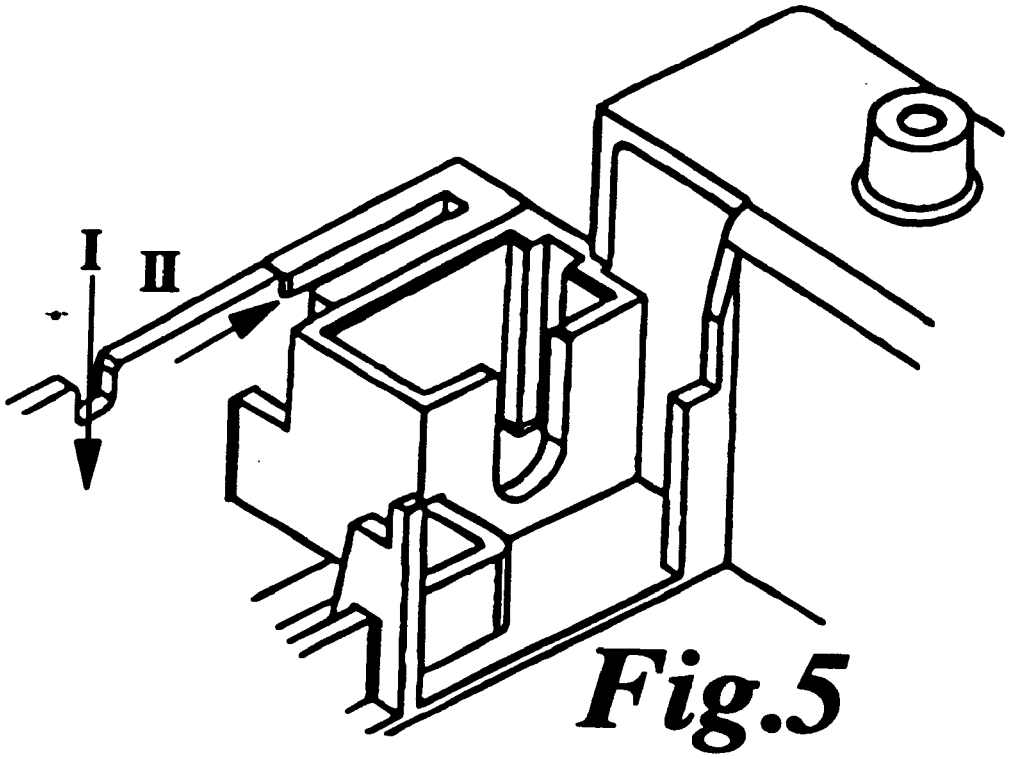
FIG. 5 shows an enlarged detail of FIG. 1 showing the housing part with the groove for accommodating the modules.

Blank module 5 can be replaced with another connecting module 2 at any time, even at a later date, when the electromagnetic switching device is expanded, for example, if a bus connection is desired. The simple arrangement and attachment of the modules for connections on housing part 1 on housing part 1 are provided on the top of the housing part in the area of two parallel side walls, in this case side walls 10, 11, near the corners of the housing part. Grooves 15, 16 and 17, 18, which are parallel to the housing walls, are machined into the housing walls or formed by widening the housing walls via a ridge. In order to facilitate the insertion of the connecting modules and the blank module, these grooves 15, 16, 17, 18 are open at their end facing one another, see openings 15*a*, 16*a*, 17*a*, 18*a*, and also FIG. 5. It is possible to attach a connecting module or a blank module 5 to housing part 1 in the central part in the direction of arrow I, (FIG. 5) and, after achieving the desired depth of insertion, to set it in the groove in a direction that is perpendicular to the direction of arrow I, i.e., in the horizontal direction, according to arrow II and to insert it and fasten it in the groove to the end of the groove (FIG. 2). In this manner, a module 2 or 5 is installed at each corner of the top of housing part 1 and is terminated by the wall, and a final fastening is achieved by inserting armature housing AG (not illustrated) in the direction of arrow AG (FIG. 2) between two modules spaced at a distance A, as these are definitively installed in housing part 1. Connection modules 2 and blank module 5 can then be removed from their positions in housing part 1 or replaced only after removing armature housing AG, i.e., when the electromagnetic switching device is disassembled.

The design of the connecting areas according to the present invention using modules, specifically one module for connections and one blank module, allows flexible manufacturing for different sizes of devices. Furthermore, it allows the coil terminal, normally permanently attached to the bobbin, to be moved to the outside into the corner area of the housing of the electromagnetic switching device, which provides good accessibility.

What is claimed is:

1. An electromagnetic switching device comprising:

a plurality of external control connections;

a housing including a first housing part and a second housing part, the first housing part includes a top surface and a plurality of corners, a magnet core and a coil being disposed in the first housing part; and a purality of connecting modules, each connecting module having a same size and shape and being disposed on the top surface in an area of a respective one of the plurality of corners of the first housing part and being for a respective external control connection of the electromagnetic switching device.

2. The electromagnetic switching device as recited in claim 1 further comprising a blank module having a shape, the shape of the blank module being the same as the shape of each of the plurality of connecting modules.

3. The electromagnetic switching device as recited in claim 2 wherein the blank module is disposed on one of the plurality of corners of the first housing part.

4. The electromagnetic switching device as recited in claim 2 wherein the first housing part includes a plurality of grooves on the top surface and wherein each of the plurality of connecting modules and the blank module includes a respective cuboidal shape and a respective narrow bottom surface, each respective narrow bottom surface including a respective T-shaped insertion ridge shaped so as to be insertable in a respective one of the plurality of grooves.

5. The electromagnetic switching device as recited in claim 4 wherein each of the plurality of connecting modules and the blank module includes a respective two vertical narrow sides, each respective insertion ridge extending a distance from the respective two vertical narrow sides.

6. The electromagnetic switching device as recited in claim 4 wherein each of the plurality of connecting modules includes a respective upper narrow side, each respective upper narrow side including two respective shoulders disposed in stepped fashion, a respective connecting clamp being disposed in each respective shoulder, each respective connecting clamp including an insertion aid.

7. The electromagnetic switching device as recited in claim 1 wherein each of the plurality of connecting modules includes a respective long vertical narrow side and a respective short vertical narrow side, each respective long vertical narrow side adapted for receiving a respective plug-in cable connector.

8. The electromagnetic switching device as recited in claim 1 wherein each of the plurality of connecting modules includes third and fourth vertical sides and at least one respective connecting clamp, each connecting clamp including an insertion aid, each third and fourth vertical side including at least one respective slot adapted for attaching a respective one of the insertion aids.

9. The electromagnetic switching device as recited in claim 1 wherein each of the plurality of connecting modules defines an interior space for receiving at least one device for suppressing electromagnetic compatibility levels.

10. The electromagnetic switching device as recited in claim 9 wherein the at least one device for suppressing electromagnetic compatibility levels includes at least one of a filter, a soft magnetic core and an absorber.

11. The electromagnetic switching device as recited in claim 2 wherein the first housing part includes two parallel side walls, the two parallel side walls each including an upper side, at least one respective ridge being disposed on each respective upper side, each respective ridge including at least one respective groove disposed parallel to the side walls, the plurality of connecting modules and the blank module being each disposed in a respective one of the at least one respective groove.

12. The electromagnetic switching device as recited in claim 11 wherein each of the at least one respective groove is open at an end for inserting of the T-shaped insertion ridge of the connecting modules or the blank module.

13. The electromagnetic switching device as recited in claim 12 wherein the respective open end of each of the at least one respective groove faces the respective open end of another one of the at least one respective groove.

* * * * *

UNITED STATES PATENT AND TRADEMARK OFFICE

CERTIFICATE OF CORRECTION

PATENT NO. : 6,297,718 B1
DATED : October 2, 2001
INVENTOR(S) : Scholz, R. et al.

It is certified that error appears in the above-identified patent and that said Letters Patent is hereby corrected as shown below:

Column 2,
Lines 54-55, delete "and ……. module;"
Below line 55 and above paragraph on line 56, insert -- FIG. 1 shows an exploded view of housing part 1 accommodating the magnet core and the coil with the connecting modules and a blank module; --

Column 4,
Line 30, change "a top" to -- an upper --
Lines 35 and 48, change "top" to -- upper --
Line 60, change "claim 4" to -- claim 1 --

Signed and Sealed this

Fourth Day of February, 2003

JAMES E. ROGAN
*Director of the United States Patent and Trademark Office*